US005413754A

United States Patent [19]

Yazawa et al.

[11] Patent Number: 5,413,754

[45] Date of Patent: May 9, 1995

[54] FERRITIC STAINLESS STEEL EXHIBITING EXCELLENT ATMOSPHERIC CORROSION RESISTANCE AND CREVICE CORROSION RESISTANCE

[75] Inventors: Yoshihiro Yazawa; Satoshi Owada; Fusao Togashi; Keiichi Yoshioka; Susumu Satoh, all of Chiba, Japan

[73] Assignee: Kawasaki Steel Corporation, Japan

[21] Appl. No.: 242,181

[22] Filed: May 13, 1994

[30] Foreign Application Priority Data

May 19, 1993 [JP] Japan ..... 5-117401

[51] Int. Cl.[6] ..... C22C 38/18

[52] U.S. Cl. ..... 420/41; 420/42

[58] Field of Search ..... 148/325; 420/41, 42

[56] References Cited

U.S. PATENT DOCUMENTS 4,581,066 4/1986 Maruhashi et al. ..... 420/42
4,824,635 4/1989 Hoshino et al. ..... 420/42

FOREIGN PATENT DOCUMENTS 4627660 8/1971 Japan ..... 420/42
2071148 9/1981 United Kingdom ..... 420/41

*Primary Examiner*—Deborah Yee
*Attorney, Agent, or Firm*—Austin R. Miller

[57] ABSTRACT

A ferritic stainless steel exhibiting excellent atmospheric corrosion resistance and crevice corrosion resistance can be provided by positively adding P thereto and by adequately adjusting Ca and Al. The ferritic stainless steel according to the present invention essentially consists of, in weight percentages, C: about 0.05% or less
Si: about 1.0% or less
Cr: about 11% or more and less than about 20%
Mn: about 1.0% or less
N: about 0.10% or less
S: about 0.03% or less
Ca: about 5 ppm or more and about 50 ppm or less
Al: about 0.5% or less
P: more than about 0.04% and about 0.20% or less and the balance being iron and incidental impurities. The stainless steel according to the present invention may also contain at least one element selected from a group (1) consisting of about 6% or less of Mo, group (2) consisting of about 1.0% or less of Cu, about 3% or less of Ni and about 3% or less of Co, or group (3) consisting of about 1.0% or less of Ti, about 1.0% or less of Nb, about 1.0% or less of V, about 1.0% or less of W, about 1.0% or less of Zr, about 1.0% or less of Ta and about 0.05% or less of B.

8 Claims, 4 Drawing Sheets

FERRITIC STAINLESS STEEL EXHIBITING EXCELLENT ATMOSPHERIC CORROSION RESISTANCE AND CREVICE CORROSION RESISTANCE

BACKGROUND OF THE INVENTION

1. Field of the Invention

The present invention relates to a ferritic stainless steel which when worked exhibits excellent atmospheric corrosion resistance and crevice corrosion resistance. Ferritic stainless steel according to the present invention is suitable to be worked and used as building exterior finish work, electric appliance parts, panels or a hot water tank bodies. Known kinds of materials heretofore were not usable for a long period of time without extensive maintenance, and required treatments for atmospheric corrosion resistance and crevice corrosion resistance.

2. Description of the Related Art

Conventional stainless steel plates, which are used as materials for building exterior finish work requiring atmospheric corrosion resistance, are used mainly in relatively small pieces, as in panels, sashes or curtain walls.

In recent years the merits of stainless steels, which merits include excellent design adaptability, fine appearance, excellent corrosion resistance and excellent atmospheric corrosion resistance, have been drawing attention. Techniques for installing such stainless steels have been developed. As a result, there is increased demand for stainless steels which can be used as large size pieces for exterior building finish work, such as roofing materials or panel materials, for example.

In that case, color painted stainless steel plates or stainless steel plates coated with a fluoroplastic have been mainly used as, for example, roofing materials.

Conventional galvanized iron roofing materials have disadvantages when painted in that the paint work tends to become faulty due to deterioration. Various types of stainless steel plates are capable of overcoming some of the disadvantages of galvanized iron materials.

Austenitic stainless steels conforming to designation SUS304 (18Cr-8Ni) have been mainly employed as stainless steel plates intended to be painted because of their excellent workability.

However, in the use of painted stainless steel plates or fluororesin coated materials, if the coating material is opaque, it is impossible to achieve a silver white metallic gloss inherent in the stainless steel. If a transparent fluororesin is used as a coating, the appearance of the surface of the stainless steel may be marred due to deterioration of the coated film. Further, since austenitic stainless steels contain a large amount of expensive Ni, they too are expensive. Also, the coefficient of thermal expansion of austenitic stainless steel is about twice that of ferritic stainless steel, and this makes austenitic stainless steel unsuited for use in elongated shapes.

Accordingly, ferritic stainless steels have recently been drawing more attention as exterior building materials.

Ferritic stainless steels, which are employed as exterior building materials, particularly as non-coated roofing materials, must exhibit excellent outdoor atmospheric corrosion resistance, even to sea salt, for a long period of time.

Where ferritic stainless steels are used as materials for exterior building finish materials, such as panels or curtain walls, since roll forming or pressing is performed in processing the stainless steel, the worked portion must also have excellent atmospheric corrosion resistance, corrosion resistance and crevice corrosion resistance.

Therefore, attempts have been made to increase the corrosion resistance of a highly atmospheric corrosion resistant and highly rust resistant ferritic stainless steel by reducing the percentages of C and N and increasing the percentages of Cr and Mo. Such a ferritic stainless steel is disclosed in, for example, Japanese Patent Laid-Open No. sho 55-138058.

However, a mere increase in the amounts of Cr and Mo produces a high alloy steel, increasing production cost and thus reducing economical usage.

Further, formability of such a steel is reduced due to hardening, and the manufacturing properties of the steel deteriorate due to its increased toughness.

Hence, there has been an increasing demand for a more inexpensive material whose atmospheric corrosion resistance, rust resistance and crevice corrosion resistance can be improved by the addition of an element other than Cr and Mo, all without formability loss of the material and loss of corrosion resistance of worked metal. It is an object of this invention to satisfy that demand. It is another object of the present invention to provide a ferritic stainless steel which is inexpensive when compared to conventional steels, and in which even worked portions such as bent or deep drawn portions exhibit excellent atmospheric corrosion resistance and crevice corrosion resistance.

SUMMARY OF THE INVENTION

In order to achieve the above objects we have now created a ferritic stainless steel which exhibits excellent atmospheric corrosion resistance and crevice corrosion resistance. Our new steel essentially consists of, in weight percent, C: about 0.05% or less
Si: about 1.0% or less
Cr: about 11% or more and less than about 20%
Mn: about 1.0% or less
N: about 0.10% or less
S: about 0.03% or less
Ca: about 5 ppm or more and about 50 ppm or less
Al: about 0.5% or less
P: more than about 0.04% and about 0.20% or less and the balance iron and incidental impurities.

The preferable amount of Al added is about 0.1% or less. A more preferable amount of Al is about 0.01% or more and about 0.1% or less.

Further, the stainless steel according to the present invention may also contain at least one element selected from a group (1) consisting of about 6% or less of Mo, or a group (2) consisting of about 1.0% or less of Cu, about 3% or less of Ni and about 3% or less of Co, or a group (3) consisting of about 1.0% or less of Ti, about 1.0% or less of Nb, about 1.0% or less of V, about 1.0% or less of W, about 1.0% or less of Zr, about 1.0% or less of Ta and about 0.05% or less of B.

DETAILED DESCRIPTION OF THE PREFERRED EMBODIMENTS

Figure 1:
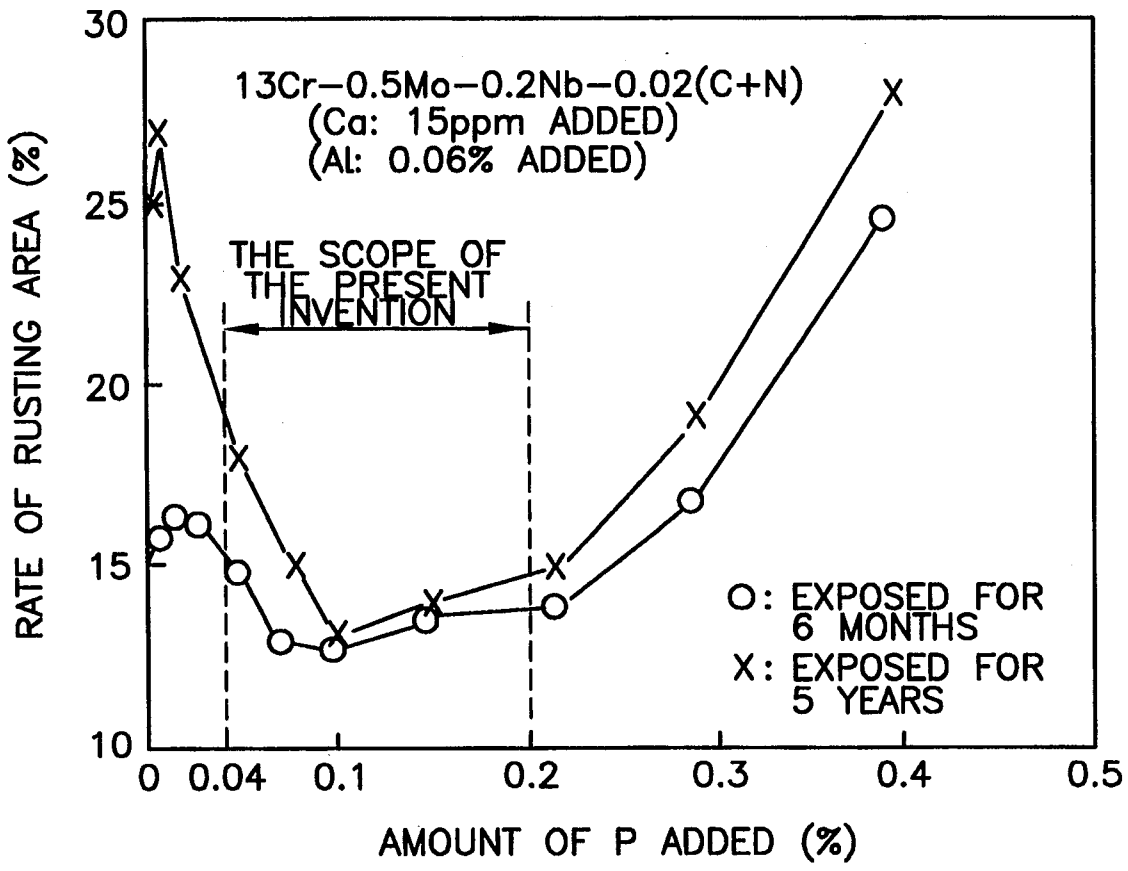
FIG. 1 is a graphic illustration of the influence of the addition of P on the rate of rusting after six months and five years in an atmospheric corrosion test.

In ferritic stainless steel according to the present invention, P is added positively in an amount which does not deteriorate workability or the manufacturing adaptability of the steel. Heretofore, reduction of the amount of P in ferritic stainless steel has been worked toward as much as possible because of its harmfulness.

Ca and Al are also added in an appropriate amount in order to control the shape and distribution of non-metallic debris and thereby improve the surface profile and cleanness of the metal. It has been found that atmospheric corrosion resistance and crevice corrosion resistance of a worked portion of the new ferritic stainless steel are improved.

When a ferritic stainless steel is used as a material for exterior finish work of a building, such as a panel or a curtain wall, the metal is bent or deep drawn in roll forming, pressing or panel working. Accordingly, the surface of a worked metal portion may become rough or cracked depending on the cleanness of the material. Rust occurs starting from such a rough portion or fine crack, decreasing the atmospheric corrosion resistance of the stainless steel.

Where the building material is joined using bolts or the like, since a crack is generated, the stainless steel must be crevice corrosion resistant.

Conventionally, efforts have not been directed to the positive addition of P to ferritic stainless steel. However, we have systematically investigated the influence of P on the atmospheric corrosion resistance, rust resistance and crevice corrosion resistance of the steel. We have discovered that reduction of manufacturing properties and workability, caused by the addition of P, can be compensated for by adding Ca and Al in order to control the shape and distribution of non-metallic debris and thereby to improve the cleanness and surface property of the steel. We have further discovered that Ca and Al can provide a material to which P can be added even in an amount specified by JIS or above in order to improve atmospheric corrosion resistance and crevice corrosion resistance, i.e., which can be suitably used as a material for exterior finish work of buildings, even when the steel requires bending, because it generates less rust and has a fine appearance.

As mentioned above, attempts have primarily been made to reduce the amount of P in a ferritic stainless steel as much as possible because P was considered harmful. It has been considered that P reduces the toughness of ferritic stainless steel and deteriorates the manufacturing properties of the steel.

More specifically, it has been known that P adversely affects the manufacturing properties of ferritic stainless steel because it is readily segregated, increasing the hot tearing properties of the steel and accelerating crack sensitivity of welded portions of the steel.

Therefore, P has been regarded as very harmful to ferritic stainless steels which have a body-centered cubic lattice structure and hence have a toughness which is lower than that of austenitic stainless steel. Accordingly, reduction of the amount of P, as much as possible, has thus been attempted.

In fact, JIS 430 specifies that the amount of P added to a high Cr ferritic stainless steel, such as SUS447J1, shall be 0.3% or less. Regrading other types of steels, P reduces toughness and workability and JIS 430 specifies that the amount of P shall be 0.04% or less.

Regarding the influence of P on the corrosion resistance of stainless steel, "Stainless Steel Hand Book" published by Nikkan Kogyo Shinbunsha describes on page 359 that the presence of P in a stainless steel, in a completely solid solution state, hardly exerts any influence and that an increase of the amount of P increases pitting corrosion sensitivity, resulting in reduction of corrosion resistance.

Under the above-described circumstances, the presence of P in a ferritic stainless steel has been considered to be very harmful to the stainless steel; efforts have been made to reduce the amount of P as much as possible.

However, we have discovered great benefit in the positive addition of P in a ferritic stainless steel, as described in detail in this specification.

The positive addition of P in a ferritic stainless steel has been proposed in, for example, Japanese Patent Laid-Open Nos. sho 55-122856, 60-248868 and 61-12825. However, although each of these patent applications discloses that the positive addition of P improves secondary workability, descaling property and high-temperature characteristics, it does not mention corrosion resistance at all.

Turning next to the drawings:

FIG. 1 illustrates influence of P on changes with time of the rate of the corroded area of a 13Cr-0.5Mo-0.2Nb-0.02(C+N) steel containing Ca and Al.

It is clear from FIG. 1 that a stainless steel with about 0.04% or above of P added thereto exhibits excellent atmospheric corrosion resistance as compared with a stainless steel containing about 0.04% or less of P, as specified by JIS.

Figure 2:
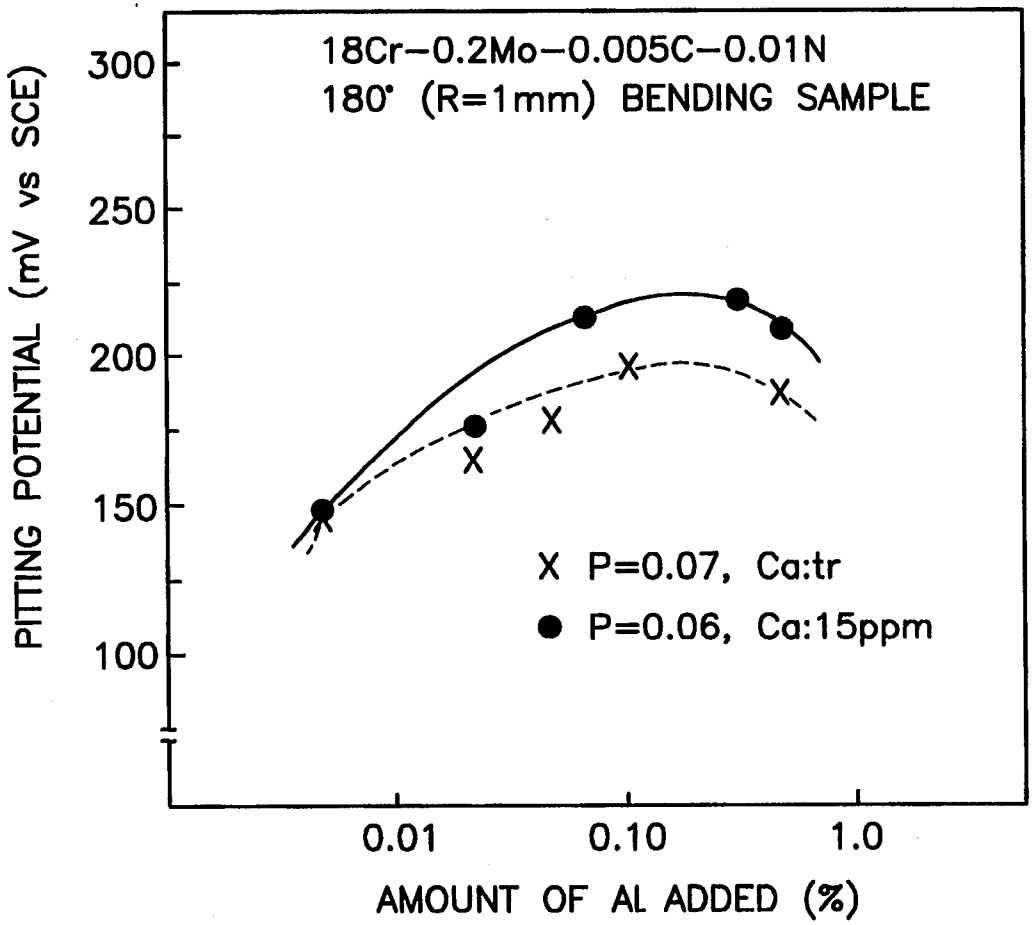
FIG. 2 is a graphic illustration of the influence of the addition of a combination of Ca and Al on the pitting potential of an 180° bent portion of metal (R =about 1 mm)

FIG. 2 illustrates an influence of Al and Ca on the pitting potential of a 180° bending portion (bend radium R =1 mm) of an 18Cr-0.2Mo-0.005C-0.01N steel.

The pitting potential was measured in a 30° C 3.5% NaCl solution in conformity with JIS G 0577. The pitting potential was the potential at which the current density reached 10 $\mu A/cm^2$.

It can be seen from FIG. 2 that the addition of Al has an effect on stainless steel containing 0.06 to 0.07% of P and 15 ppm of Ca as compared with steel containing no Ca, and that the effect of the composite addition of Al and Ca can be observed in stainless steel containing about 0.06 to 0.07% of P and about 15 ppm of Ca.

Figure 3:
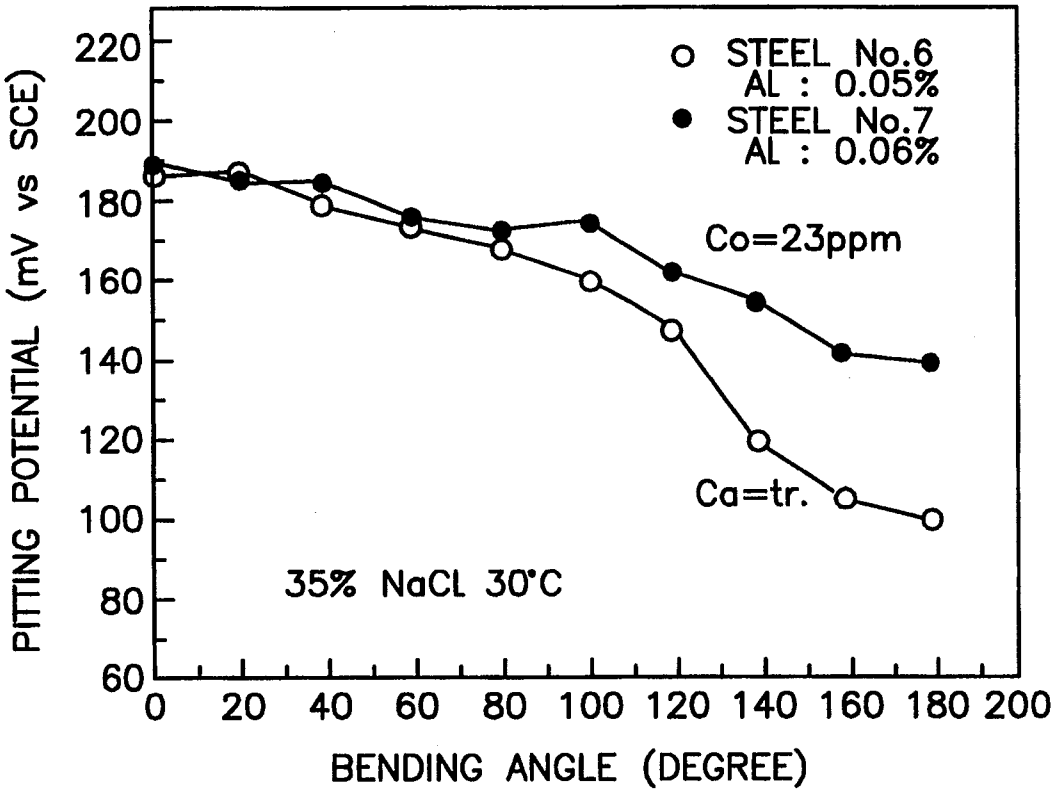
FIG. 3 is a graphic illustration of the influence of the addition of a combination of Ca and Al on the pitting potential and the sample bending angle of metal.
Figure 4:
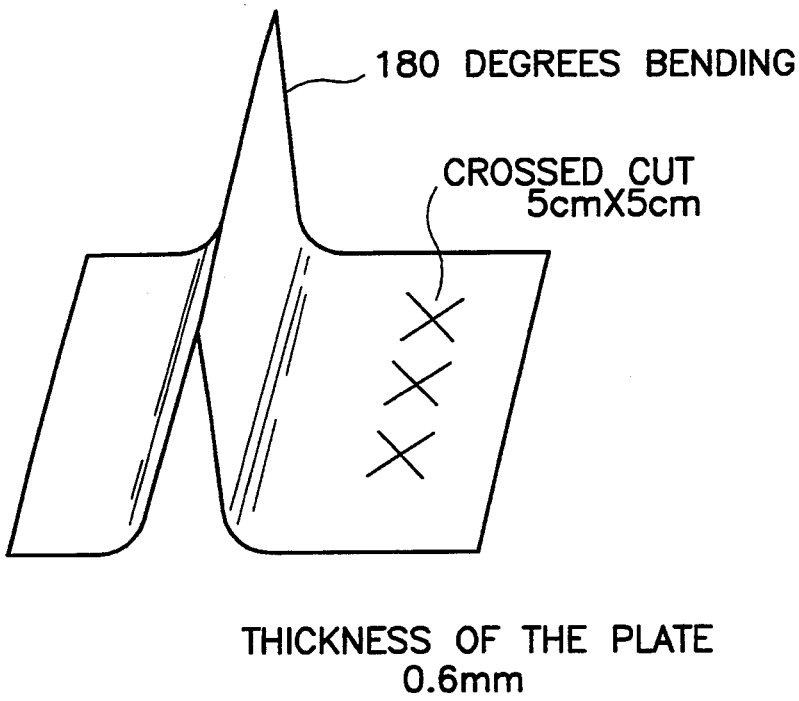
FIG. 4 is a view showing the shape of a typical sample.

FIG. 3 illustrates the results of the measurements of pitting potential obtained after a bending test in which each of sample Nos. 6 and 7, shown in Table 1, was bent at an angle ranging from 0 degree to 180 degrees at intervals of 20 degrees.

It can be seen from FIG. 3 that in sample No. 6 (Ca, a trace amount, Al: 0.05%: Comparative Example) and sample No. 7 (Ca: 23 ppm, A;: 0.06%: Example of the present invention), as the bending angle increases, a difference of the pitting resistance of the steel increases, and that steel with Ca added has excellent pitting resistance as compared to steel containing no Ca.

We studied the effect of the addition of a combination of Ca and Al, and found that the addition of a combination of Ca and Al greatly affects the amount, the shape and distribution of non-metallic debris.

| | Steel with a combination of Ca and Al added | Conventional steel |
|---|---|---|
| Composition | Corresponding to that of sample No. 7 in Table 1 | Corresponding to that of sample No. 6 in Table 1 |
| Shape of non-metallic debris | Monotectic oxide debris | Strange-shaped or batched oxide |
| Ductility of non-metallic debris | Excellent ductility | Degraded ductility |
| Area of debris percentage % | 0.13 | 0.42 |
| Surface defects | Reduced | |

*Conforming to JIS G0555 "Method of microscopically testing non-metallic debris of a steel"

From the above it can be seen that not only atmospheric corrosion resistance and crevice corrosion resistance of a flat plate but also those of a worked portion can be improved by adding P in an amount exceeding about 0.04% which is specified by JIS, and by further adding Ca and Al.

P, an inexpensive element, can replace an element such as Cr or Mo which is effective to improve the atmospheric corrosion resistance and crevice corrosion resistance of a steel, thus reducing production cost. Further, since the conventionally required process of reducing the amount of P can be eliminated or shortened, the material cost and the cost required to remove P can be reduced. Accordingly, the industrial contribution of the steel according to the present invention is great.

The reasons for restricting the composition of the steel according to the present invention to the above-described ranges will now be explained. Each unit is expressed as weight percent, unless otherwise specified, with the exception that Ca is expressed as parts per million (ppm).

C, N:

C and N are elements which greatly affect hot workability, toughness and rusting resistance. Since the manufacturing property of the steel according to the present invention is subject to deterioration by the addition of P, the upper limit of C is set to about 0.05% and that of N is set to about 0.10% in order to secure these manufacturing properties and workability. Further, the effect of reducing these elements is not limited, i.e., the less the amount of C or N, the better, and thus there is no lower limit thereof. From the actual manufacturing viewpoint, however, a desirable amount of C is $\geqq$10 ppm, and desirable amount of N is $\geqq$20 ppm.

Cr:

Cr is an essential element which determines the basic corrosion resistance of the steel according to the present invention. Although an increase in the amount of Cr improves corrosion resistance, the addition of Cr in an amount exceeding about 20% deteriorates workability of the steel with P added thereto, particularly, the ductility thereof, thus making roll forming or panel working difficult and readily generating cracks where the metal has been worked. Consequently, the upper limit of Cr is set to less than about 20%. Further, since the addition of Cr in an amount less than about 11% does not offer sufficient corrosion resistance and atmospheric corrosion resistance, the lower limit thereof is set to about 11%. desirable amount of Cr is about 15% to about 18%.

Si:

Si is added as a deoxidizing agent and is effective to improve oxidation resistance and cleanness.

The present inventors also found that the addition of Si is effective to improve atmospheric corrosion resistance and rusting resistance. The upper limit of Si is about 1.0% because the addition of Si in an excessive amount reduces elongation and toughness due to solid-solution strengthening.

Mn:

Mn is an element which generates an austenitic structure at high temperatures and a martensitic structure when the steel is cooled after high-temperature treatment. Mn is used as a deoxidizing agent in the steel manufacturing process. Since the addition of Mn in an amount exceeding about 1.0% is harmful to hot working, the upper limit thereof is set to about 1.0%. A desirable amount of Mn is about 0.3% or less.

S:

S is harmful to the mechanical properties and weldability of the steel. Further, since, rust starts from debris, such as Mn or S, the presence of S reduces atmospheric corrosion resistance and rust resistance. Therefore, the lower the proportion of S, the better. Particularly, since the presence of S in an amount exceeding about 0.03% greatly deteriorates atmospheric corrosion resistance, rust resistance and crevice corrosion resistance, the upper limit of S is set to about 0.03%. A desirable amount of S is about 0.07% or less.

Al:

Al has a deoxidizing effect, and is thus added as a deoxidizing agent. Further, the presence of Al restricts the formation of MnO or FeO which accelerates refractory product penetration as well as silicate, thus reducing the amount of oxide debris formed by refractory product penetration and improving the manufacturing property and workability of a steel. The addition of Al in an amount exceeding about 0.5% accelerates the generation of macro debris and reduces workability due to scattering of debris, so the upper limit is set to about 0.5%. A desirable amount of Al is about 0.1% or less. Further, since the addition of Al in an amount less than about 0.01% has essentially no effect, the lower limit thereof is set to about 0.01% or more.

Ca:

Ca improves the cleanness and surface property of the steel according to the present invention, improves the characteristics of the steel and adjusts the shape and distribution of non-metallic debris. That is, Ca has the effect of adjusting the shape and distribution of non-metallic debris of the deoxidized steel, i.e., Ca does not form a continuous brittle layer of debris but is effective to form so-called monotectic debris having excellent ductility, thus improving workability. The addition of Ca in an amount of about 5 ppm or more has the effect of reducing cracks caused by debris in the worked portion, and together with the addition of P, has the effect of improving atmospheric corrosion resistance and crevice corrosion resistance. However, the addition of Ca in an excessive amount deteriorates the surface property and corrosion resistance caused by CaO. Thus, the upper limit is about 50 ppm. A desirable amount of Ca is about 3 ppm to about 15 ppm.

P:

P is effective to improve corrosion resistance, atmospheric corrosion resistance and crevice corrosion resistance. The effect of adding P becomes clear when the amount of P added exceeds about 0.04%. Thus, the lower limit is set to more than about 0.04%. The addition of P in an amount exceeding about 0.2% deteriorates not only workability and manufacturing property but also rust resistance. Thus, the upper limit is set to about 0.2%. A preferable amount of P is more than about 0.04% and about 0.1% or less.

Mo:

Mo is an element which greatly improves corrosion resistance and atmospheric corrosion resistance of the steel according to the present invention, and which is very effective to improve rusting resistance, pitting corrosion resistance and crevice corrosion resistance. Further, the effect of the addition of Mo is further accelerated by increasing the amount of Cr added. However, since the addition of Mo in an amount exceeding about 6.0% reduces toughness and greatly deteriorates manufacturing properties, thus deteriorating economic efficiency, the desirable amount of Mo is restricted to about 6.0% or less. A more preferable amount is about 2.0% or less.

Ni, Co, Cu:

Ni, Co and Cu are effective to improve atmospheric corrosion resistance, corrosion resistance, oxidation resistance and crevice corrosion resistance. In addition, Ni and Co are effective to improve toughness. The addition of Cu in an amount exceeding about 1.0% deteriorates hot workability and hardens the steel. The addition of Ni or Co in an amount exceeding about 3.0% reduces workability and hence economical efficiency. Thus, a desirable amount of Ni or Co is 3% or less, and a desirable amount of Cu is about 1.0% or less. More desirable amounts of Ni, Co and Cu are, respectively, about 1.0% or less, about 1.0% or less and about 0.6% or less.

Nb, Ti, V, Zr, Ta, W, B:

Nb, Ti, V, Zr, Ta, W and B are carbide and nitride forming elements and improve atmospheric corrosion resistance, formability and corrosion resistance of a welded portion. When the amount of Nb, Ti, V, Zr, Ta or W exceeds about 1.0% and the amount of B exceeds about 0.05%, the effect of the addition is saturated and workability is deteriorated. Thus, a desirable amount of Nb, Ti, V, Zr, Ta or W is set to about 1.0% or less. When the amount of B, which also improves secondary workability, exceeds about 0.05%, the effect of the addition thereof is saturated and workability is deteriorated. Thus, a desirable amount of B is about 0.05% or less. More preferable amounts of Nb, Ti, V, Zr, Ta, W and B are, respectively, about 0.5% or less, about 0.3% or less, about 0.2% or less, about 0.3% or less, about 0.3% or less, about 0.2% or less and about 0.02% or less.

The ferritic stainless steel with P added according to the present invention exhibits excellent atmospheric corrosion resistance and crevice corrosion resistance, and can thus be utilized for materials for building exterior finish materials (roofing materials or panels for exterior finish work) to be worked, hot water tank bodies or materials to be coated. The steel according to the present invention can be manufactured from molten steel having the above-described composition by a normal manufacturing process, i.e., by conducting melting, hot rolling, annealing, acid pickling, cool rolling, annealing, (acid pickling), and finish rolling (temper rolling).

Further, no matter in what application the steel according to the present invention may be applied, for example, as a hot rolled annealed plate or a cool rolled annealed plate (No. 2 D finish, No. 2B finish, bright annealed finish, hair line finish, polished finish, dull finish), when the steel is worked by, for example, roll forming, the formed portion exhibits excellent corrosion resistance, atmospheric corrosion resistance and crevice corrosion resistance.

EXAMPLES

Examples of the present invention will be described below in detail.

Each of 30 kg small steel ingots having compositions shown in Table 1 was melted by a vacuum high-frequency furnace, and then heated at 1250° C. for an hour to obtain a 4 mm-thick hot rolled plate. Thereafter, the hot rolled plate was allowed to cool to obtain a hot rolled annealed plate. After the plate was subjected to shot blasting and then acid pickling, it was cool rolled to a thickness of 0.6 mm. The cool rolled plate was heated again for 30 seconds in a temperature range between 950° C. and 1150° C., and then allowed to cool.

The thus-obtained material was worked in the manner shown in FIG. 1. That is, a 180° bending portion, having a bend radius of R = 1 mm, was formed in the material, and crossed cuts, each having dimensions of 5 cm × 5 cm, were formed in a flat plate portion of the material.

The atmospheric corrosion test (JIS Z 2381) was conducted on the worked samples to investigate atmospheric corrosion resistance (the rate of the rusting area) thereof. The test was conducted by exposing the sample, two for every type of samples, to the atmosphere for three years on a rack placed at a distance of 50 m from the coastline in such a manner that it was directed to the South and inclined an angle of 36 degrees. This testing method was in conformity with JIS.

Table 2 shows the results of the test obtained after three years of testing period, the results including the following items:

(1) the proportion of the rusting area (%) having dimensions of 10 cm × 10 cm of a flat surface portion (2) the corrosion resistance of the crossed cut portion:
x rusting
∘ no rusting
∘∘x two crossed cuts did not rust while one crossed cut rusted Further, the crevice corrosion resistance test was conducted on the samples.

Table 2 also shows the results of this test.

The crevice corrosion resistance test was conducted by forming a 5 mm-diameter hole in each of the samples and immersing the sample in 10% ferric chloride solution-3% salt water for 24 hours. The presence or absence of generated corrosion was visually detected.

The evaluation standards of the test are as follows:

● crevice corrosion was generated at a testing temperature of 40° C.

○ crevice corrosion was generated at a testing temperature of 45 ° C.

◎ no crevice corrosion was generated at a testing temperature of 45 ° C.

In addition, the pitting potential (mVVSSCE, Saturated Calomel Electrode) of a 180-degree bending portion of each of the samples was measured.

Table 2 also shows the results of the measurements.

The pitting potential was measured in conformity with JIS G 0577 by immersing the sample having a 180-degree bending portion in 30° C. 3.5% NaCl solution and then by measuring the potential at which the current density reached 10 $\mu A/cm^2$.

The higher the pitting potential, the better the pitting corrosion resistance.

Measurement of the pitting potential was conducted five times for every sample, and the average value of the obtained values was used as the measured value.

As can be seen from Tables 1 and 2, the steels according to the present invention exhibited excellent results in all the testing items including the proportion of the rusting area, corrosion of the crossed cut portion, corrosion of the 180-degree bending portion, crevice corrosion resistance and the pitting potential of the 180-degree bending portion.

As will be understood from the foregoing description, the ferritic stainless steel with a combination of Ca, Al and P added thereto according to the present invention is a low alloy steel as compared with a conventional steel, and has a worked portion exhibiting excellent atmospheric corrosion resistance and rusting resistance. Further, the steel according to the present invention exhibits excellent crevice corrosion resistance, can be manufactured at a low cost, and can thus be very effective on an industrial basis.

TABLE 1-1

| Sample No. | Chemical composition of samples (weight percent) C | Si | Cr | Mn | N | S | Ca (ppm) | Al | P | Ti, Nb, V, W, Zr, Ta, B | Cu, Ni, Co | Mo | Remarks |
|---|---|---|---|---|---|---|---|---|---|---|---|---|---|
| 1 | 0.003 | 0.21 | 14.0 | 0.05 | 0.005 | 0.003 | 11 | 0.05 | 0.02 | Ti = 0.1 | tr | 0.3 | Comparative ex. |
| 2 | 0.003 | 0.19 | 15.2 | 0.06 | 0.004 | 0.003 | 13 | 0.06 | 0.03 | Nb = 0.2 | tr | tr | Comparative ex. |
| 3 | 0.003 | 0.18 | 14.3 | 0.09 | 0.006 | 0.002 | 19 | 0.08 | 0.10 | tr | tr | tr | Present invention |
| 4 | 0.004 | 0.21 | 19.0 | 0.08 | 0.005 | 0.001 | 12 | 0.05 | 0.08 | tr | tr | 0.5 | Present invention |
| 5 | 0.003 | 0.21 | 15.2 | 0.06 | 0.005 | 0.002 | 10 | 0.09 | 0.25 | Nb = 0.2 | tr | tr | Comparative ex. |
| 6 | 0.004 | 0.18 | 18.5 | 0.08 | 0.006 | 0.002 | tr | 0.05 | 0.07 | tr | Cu = 0.2 | tr | Comparative ex. |
| 7 | 0.003 | 0.15 | 18.1 | 0.06 | 0.008 | 0.002 | 23 | 0.06 | 0.07 | tr | Cu = 0.4 | tr | Present invention |
| 8 | 0.003 | 0.13 | 13.1 | 0.09 | 0.006 | 0.003 | 52 | 0.07 | 0.08 | tr | Co = 0.1 | tr | Comparative ex. |
| 9 | 0.005 | 0.09 | 19.0 | 0.08 | 0.005 | 0.004 | 12 | 0.06 | 0.07 | tr | Ni = 0.3<br>Co = 0.1 | tr | Present invention |
| 10 | 0.003 | 0.23 | 19.2 | 0.07 | 0.008 | 0.002 | 18 | 0.08 | 0.07 | Nb = 0.3<br>Zr = 0.1<br>V = 0.05 | tr | 0.5 | Present invention |
| 11 | 0.002 | 0.08 | 16.3 | 0.08 | 0.010 | 0.002 | 26 | 0.08 | 0.11 | Ti = 0.1<br>Nb = 0.1<br>Ta = 0.2 | tr | tr | Present invention |
| 12 | 0.002 | 0.05 | 13.3 | 0.08 | 0.004 | 0.003 | 11 | 0.07 | 0.08 | B = 0.003<br>W = 0.05<br>Nn = 0.05 | Ni = 0.5 | 2.0 | Present invention |
| 13 | 0.003 | 0.10 | 19.2 | 0.05 | 0.006 | 0.002 | 7 | 0.01 | 0.07 | tr | tr | 0.8 | Present invention |
| 14 | 0.003 | 0.15 | 17.8 | 0.07 | 0.004 | 0.002 | 18 | 0.09 | 0.10 | Nb = 0.4 | tr | tr | Present invention |

TABLE 1-2

| Sample No. | Chemical composition of samples (weight percent) C | Si | Cr | Mn | N | S | Ca (ppm) | Al | P | Ti, Nb, V, W, Zr, Ta, B | Cu, Ni, Co | Mo | Remarks |
|---|---|---|---|---|---|---|---|---|---|---|---|---|---|
| 15 | 0.011 | 0.11 | 18.21 | 0.05 | 0.004 | 0.002 | 10 | 0.05 | 0.08 | tr | tr | tr | Present invention |
| 16 | 0.038 | 0.12 | 18.0 | 0.04 | 0.003 | 0.001 | 12 | 0.04 | 0.09 | tr | tr | 0.02 | Present invention |
| 17 | 0.052 | 0.09 | 17.3 | 0.03 | 0.002 | 0.002 | 11 | 0.04 | 0.09 | tr | tr | tr | Comparative ex. |
| 18 | 0.002 | 0.08 | 18.1 | 0.05 | 0.043 | 0.002 | 10 | 0.05 | 0.09 | tr | tr | tr | Present invention |
| 19 | 0.003 | 0.09 | 17.2 | 0.05 | 0.090 | 0.002 | 19 | 0.05 | 0.10 | tr | Cu = 0.2 | tr | Present invention |
| 20 | 0.003 | 0.08 | 17.3 | 0.05 | 0.004 | 0.015 | 12 | 0.05 | 0.11 | tr | tr | tr | Present invention |
| 21 | 0.004 | 0.09 | 18.1 | 0.06 | 0.005 | 0.025 | 12 | 0.05 | 0.10 | tr | tr | tr | Present invention |
| 22 | 0.002 | 0.09 | 18.1 | 0.06 | 0.004 | 0.002 | 35 | 0.05 | 0.10 | tr | Ni = 0.1 | tr | Present invention |
| 23 | 0.003 | 0.10 | 18.0 | 0.07 | 0.004 | 0.002 | 8 | 0.21 | 0.10 | tr | tr | tr | Present invention |
| 24 | 0.003 | 0.08 | 17.9 | 0.07 | 0.005 | 0.002 | 8 | 0.06 | 0.10 | Ti = 0.11 | tr | tr | Present invention |
| 25 | 0.003 | 0.07 | 17.8 | 0.07 | 0.004 | 0.002 | 15 | 0.05 | 0.10 | Nb = 0.15 | tr | tr | Present invention |
| 26 | 0.003 | 0.08 | 17.3 | 0.07 | 0.004 | 0.003 | 10 | 0.05 | 0.10 | V = 0.08 | tr | tr | Present invention |
| 27 | 0.004 | 0.09 | 17.8 | 0.06 | 0.004 | 0.003 | 8 | 0.06 | 0.10 | W = 0.05 | tr | tr | Present invention |
| 28 | 0.004 | 0.08 | 16.9 | 0.08 | 0.004 | 0.003 | 10 | 0.06 | 0.09 | Zr = 0.1 | tr | tr | Present invention |
| 29 | 0.003 | 0.07 | 17.8 | 0.06 | 0.004 | 0.003 | 5 | 0.06 | 0.09 | Ta = 0.2 | tr | tr | Present invention |
| 30 | 0.003 | 0.08 | 17.8 | 0.08 | 0.004 | 0.002 | 13 | 0.06 | 0.09 | B = 0.05 | tr | tr | Present invention |
| 31 | 0.003 | 0.06 | 17.8 | 0.06 | 0.005 | 0.003 | 18 | 0.07 | 0.10 | Nb = 0.20<br>B = 0.03 | tr | tr | Present invention |

TABLE 1-3

| Sample No. | Chemical composition of samples (weight percent) C | Si | Cr | Mn | N | S | Ca (ppm) | Al | P | Ti, Nb, V, W, Zr, Ta, B | Cu, Ni, Co | Mo | Remarks |
|---|---|---|---|---|---|---|---|---|---|---|---|---|---|
| 32 | 0.003 | 0.15 | 17.8 | 0.06 | 0.005 | 0.002 | 13 | 0.05 | 0.09 | Ti = 0.11<br>V = 0.08<br>B = 0.003 | tr | 0.10 | Present invention |
| 33 | 0.004 | 0.18 | 17.8 | 0.06 | 0.005 | 0.001 | 10 | 0.04 | 0.08 | Ti = 0.03<br>Nb = 0.05<br>W = 0.02 | tr | tr | Present invention |

TABLE 1-3-continued

| Sample No. | C | Si | Cr | Mn | N | S | Ca (ppm) | Al | P | Ti, Nb, V, W, Zr, Ta, B | Cu, Ni, Co | Mo | Remarks |
|---|---|---|---|---|---|---|---|---|---|---|---|---|---|
| | | | | | | | Chemical composition of samples (weight percent) | | | | | | |
| 34 | 0.004 | 0.17 | 17.9 | 0.06 | 0.005 | 0.002 | 11 | 0.04 | 0.09 | B = 0.001<br>Ti = 0.02<br>Nb = 0.05<br>Zr = 0.01<br>Ta = 0.01 | tr | tr | Present invention |
| 35 | 0.003 | 0.15 | 17.9 | 0.06 | 0.005 | 0.002 | 12 | 0.03 | 0.09 | tr | Cu = 0.1 | 0.15 | Present invention |
| 36 | 0.004 | 0.20 | 17.7 | 0.06 | 0.006 | 0.001 | 10 | 0.02 | 0.08 | tr | Ni = 0.2 | tr | Present invention |
| 37 | 0.004 | 0.15 | 18.1 | 0.07 | 0.005 | 0.002 | 13 | 0.09 | 0.11 | tr | Co = 0.21 | 1.0 | Present invention |
| 38 | 0.004 | 0.16 | 18.0 | 0.07 | 0.006 | 0.002 | 11 | 0.05 | 0.09 | tr | Cu = 0.1<br>Ni = 0.2 | tr | Present invention |
| 39 | 0.004 | 0.15 | 18.2 | 0.08 | 0.007 | 0.002 | 9 | 0.04 | 0.10 | tr | Co = 0.1<br>N = 0.1<br>Cu = 0.1 | tr | Present invention |
| 40 | 0.003 | 0.15 | 18.0 | 0.06 | 0.005 | 0.002 | 12 | 0.002 | 0.11 | tr | tr | tr | Present invention |
| 41 | 0.004 | 0.10 | 18.0 | 0.06 | 0.005 | 0.002 | 10 | 0.09 | 0.10 | tr | tr | 1.5 | Present invention |
| 42 | 0.004 | 0.09 | 17.9 | 0.07 | 0.004 | 0.003 | 8 | 0.43 | 0.09 | tr | tr | tr | Present invention |
| 43 | 0.005 | 0.15 | 17.2 | 0.06 | 0.005 | 0.002 | 15 | 0.52 | 0.11 | tr | tr | tr | Comparative ex. |

TABLE 2-1

| Sample No. | Rate of the rusting area (%) | Corrosion of the crossed cut portion | Corrosion of the 180° bending portion | Crevice corrosion resistance | Pitting potential of the 180° bending portion | Remarks |
|---|---|---|---|---|---|---|
| | | Results of corrosion tests | | | | |
| 1 | 22 | ○○x | x | ◎ | 98 | Comparative example |
| 2 | 15 | ○○x | ○ | ○ | 100 | Comparative example |
| 3 | 10 | ○○○ | ○ | ◎ | 110 | Present invention |
| 4 | 1 | ○○○ | ○ | ◎ | 159 | Present invention |
| 5 | 14 | ○○x | x | ○ | 113 | Comparative example |
| 6 | 10 | ○○x | x | ◎ | 104 | Comparative example |
| 7 | 5 | ○○○ | ○ | ◎ | 145 | Present invention |
| 8 | 21 | ○○x | ○ | ◎ | 159 | Comparative example |
| 9 | 4 | ○○○ | ○ | ◎ | 150 | Present invention |
| 10 | 0 | ○○○ | ○ | ◎ | 163 | Present invention |
| 11 | 19 | ○○○ | ○ | ◎ | 129 | Present invention |
| 12 | 5 | ○○○ | ○ | ◎ | 165 | Present invention |
| 13 | 8 | ○○○ | ○ | ◎ | 133 | Present invention |
| 14 | 7 | ○○○ | ○ | ◎ | 143 | Present invention |

TABLE 2-2

| Sample No. | Rate of the rusting area (%) | Corrosion of the crossed cut portion | Corrosion of the 180° bending portion | Crevice corrosion resistance | Pitting potential of the 180° bending portion | Remarks |
|---|---|---|---|---|---|---|
| | | Results of corrosion tests | | | | |
| 15 | 12 | ○○○ | ○ | ◎ | 131 | Present invention |
| 16 | 17 | ○○○ | ○ | ○ | 125 | Present invention |
| 17 | 24 | ○○x | x | ◎ | 60 | Comparative example |
| 18 | 18 | ○○○ | ○ | ◎ | 115 | Present invention |
| 19 | 8 | ○○○ | x | ◎ | 150 | Present invention |
| 20 | 9 | ○○○ | x | ◎ | 133 | Present invention |
| 21 | 11 | ○○○ | ○ | ◎ | 120 | Present invention |
| 22 | 8 | ○○○ | ○ | ◎ | 140 | Present invention |
| 23 | 3 | ○○○ | ○ | ◎ | 151 | Present invention |
| 24 | 5 | ○○○ | ○ | ◎ | 140 | Present invention |
| 25 | 5 | ○○○ | ○ | ◎ | 144 | Present invention |
| 26 | 7 | ○○○ | ○ | ◎ | 138 | Present invention |
| 27 | 6 | ○○○ | ○ | ◎ | 142 | Present invention |
| 28 | 5 | ○○○ | ○ | ◎ | 141 | Present invention |
| 29 | 5 | ○○○ | ○ | ◎ | 150 | Present invention |

TABLE 2-3

| Sample No. | Rate of the rusting area (%) | Corrosion of the crossed cut portion | Corrosion of the 180° bending portion | Crevice corrosion resistance | Pitting potential of the 180° bending portion | Remarks |
|---|---|---|---|---|---|---|
| | | Results of corrosion tests | | | | |
| 30 | 8 | ○○○ | ○ | ◎ | 138 | Present invention |
| 31 | 3 | ○○○ | ○ | ◎ | 149 | Present invention |
| 32 | 3 | ○○○ | ○ | ◎ | 151 | Present invention |
| 33 | 7 | ○○○ | ○ | ◎ | 143 | Present invention |
| 34 | 6 | ○○○ | ○ | ◎ | 140 | Present invention |

TABLE 2-3-continued

| Sample No. | Rate of the rusting area (%) | Corrosion of the crossed cut portion | Results of corrosion tests: Corrosion of the 180° bending portion | Crevice corrosion resistance | Pitting potential of the 180° bending portion | Remarks |
|---|---|---|---|---|---|---|
| 35 | 7 | ○○○ | ○ | ◎ | 138 | Present invention |
| 36 | 8 | ○○○ | ○ | ◎ | 142 | Present invention |
| 37 | 14 | ○○○ | ○ | ◎ | 130 | Present invention |
| 38 | 12 | ○○○ | ○ | ◎ | 138 | Present invention |
| 39 | 12 | ○○○ | ○ | ◎ | 130 | Present invention |
| 40 | 12 | ○○○ | ○ | ◎ | 129 | Present invention |
| 41 | 0 | ○○○ | ○ | ◎ | 285 | Present invention |
| 42 | 3 | ○○x | ○ | ◎ | 140 | Present invention |
| 43 | 29 | ○xx | x | ◎ | 69 | Comparative example |

What is claimed is:

1. A ferritic stainless steel exhibiting excellent atmospheric corrosion resistance and crevice corrosion resistance, said ferritic stainless steel essentially consisting of, in weight percentages, C: about 0.05% or less Si: about 1.0% or less Cr: about 11% or more and less than about 20%

Mn: about 1.0% or less

N: about 0.10% or less

S: about 0.03% or less

Ca: about 5 ppm or more and about 50 ppm or less

Al: about 0.5% or less

P: more than about 0.04% and about 0.20% or less, and the balance being iron and incidental impurities.

2. A ferritic stainless steel exhibiting excellent atmospheric corrosion resistance and crevice corrosion resistance, said ferritic stainless steel essentially consisting of, in addition to the components described in claim 1, about 6% or less of Mo.

3. A ferritic stainless steel exhibiting excellent atmospheric corrosion resistance and crevice corrosion resistance, said ferritic stainless steel essentially consisting of, in addition to the components described in claim 1, at least one element selected from a group consisting of about 1.0% or less of Cu, about 3% or less of Ni and about 3% or less of Co.

4. A ferritic stainless steel exhibiting excellent atmospheric corrosion resistance and crevice corrosion resistance, said ferritic stainless steel essentially consisting of, in addition to the components described in claim 2, at least one element selected from a group consisting of about 1.0% or less of Cu, about 3% or less of Ni and about 3% or less of Co.

5. A ferritic stainless steel exhibiting excellent atmospheric corrosion resistance and crevice corrosion resistance, said ferritic stainless steel essentially consisting of, in addition to the components described in claim 1, at least one element selected from a group consisting of about 1.0% or less of Ti, about 1.0% or less of Nb, about 1.0% or less of V, about 1.0% or less of W, about 1.0% or less of Zr, about 1.0% or less of Ta and about 0.05% or less of B.

6. A ferritic stainless steel exhibiting excellent atmospheric corrosion resistance and crevice corrosion resistance, said ferritic stainless steel essentially consisting of, in addition to the components described in claim 2, at least one element selected from a group consisting of about 1.0% or less of Ti, about 1.0% or less of Nb, about 1.0% or less of V, about 1.0% or less of W, about 1.0% or less of Zr, about 1.0% or less of Ta and about 0.05% or less of B.

7. A ferritic stainless steel exhibiting excellent atmospheric corrosion resistance and crevice corrosion resistance, said ferritic stainless steel essentially consisting of, in addition to the components described in claim 3, at least one element selected from a group consisting of about 1.0% or less of Ti, about 1.0% or less of Nb, about 1.0% or less of V, about 1.0% or less of W, about 1.0% or less of Zr, about 1.0% or less of Ta and about 0.05% or less of B.

8. A ferritic stainless steel exhibiting excellent atmospheric corrosion resistance and crevice corrosion resistance, said ferritic stainless steel essentially consisting of, in addition to the components described in claim 4, at least one element selected from a group consisting of about 1.0% or less of Ti, about 1.0% or less of Nb, about 1.0% or less of V, about 1.0% or less of W, about 1.0% or less of Zr, about 1.0% or less of Ta and about 0.05% or less of B.

* * * * *